United States Patent [19]

Brown, deceased et al.

[11] 4,126,193

[45] Nov. 21, 1978

[54] MOBILE DRILLING APPARATUS

[76] Inventors: Cicero C. Brown, deceased, late of Houston, Tex.; by Joe R. Brown, executor, P.O. Box 19236, Houston, Tex. 77024

[21] Appl. No.: 668,439

[22] Filed: Mar. 19, 1976

[51] Int. Cl.[2] ..... E21B 7/02

[52] U.S. Cl. ..... 175/171; 173/28; 173/43; 175/173; 175/320; 175/324; 403/33

[58] Field of Search ..... 175/213, 324, 320, 171, 175/173; 173/28, 43; 166/71; 52/116, 120; 403/33

[56] References Cited

U.S. PATENT DOCUMENTS

| | | | |
|---|---|---|---|
| 1,567,294 | 12/1925 | Pihl | 403/33 |
| 2,914,306 | 11/1959 | Failing | 175/213 X |
| 3,033,527 | 5/1962 | Wilson | 52/116 |
| 3,623,558 | 11/1971 | Brown | 175/171 |
| 3,645,343 | 2/1972 | Mays | 173/28 |
| 3,655,001 | 4/1972 | Hoffman | 175/213 |
| 3,794,126 | 2/1974 | Pereau | 175/173 |
| 3,919,816 | 11/1975 | Ranft | 173/28 X |

*Primary Examiner*—Ernest R. Purser
*Assistant Examiner*—William F. Pate, III
*Attorney, Agent, or Firm*—Browning, Bushman & Zamedki

[57] ABSTRACT

Drilling apparatus mounted on a self-propelled base equipped with a joint to permit use on uneven terrain and drilling at various angles with respect to the terrain surface; embodiments of the invention feature suction apparatus for removing drill cuttings, and foldable masts.

38 Claims, 17 Drawing Figures

Fig. 7A
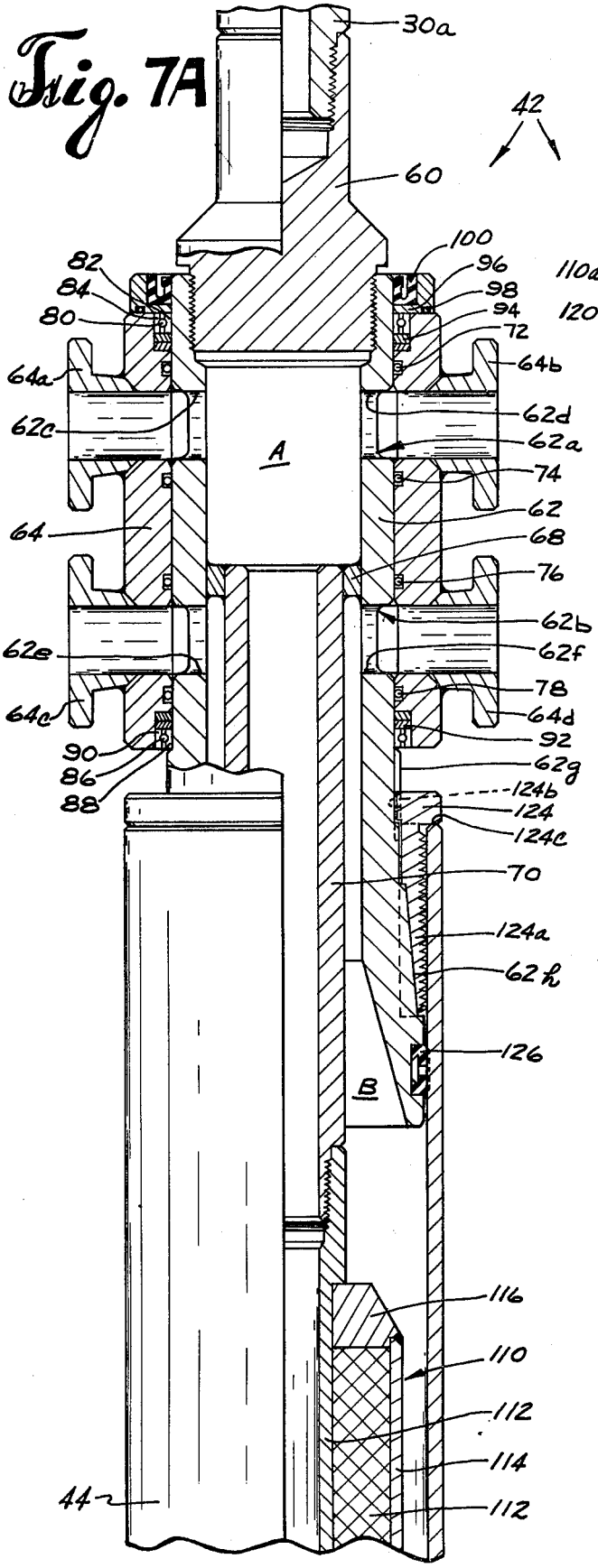
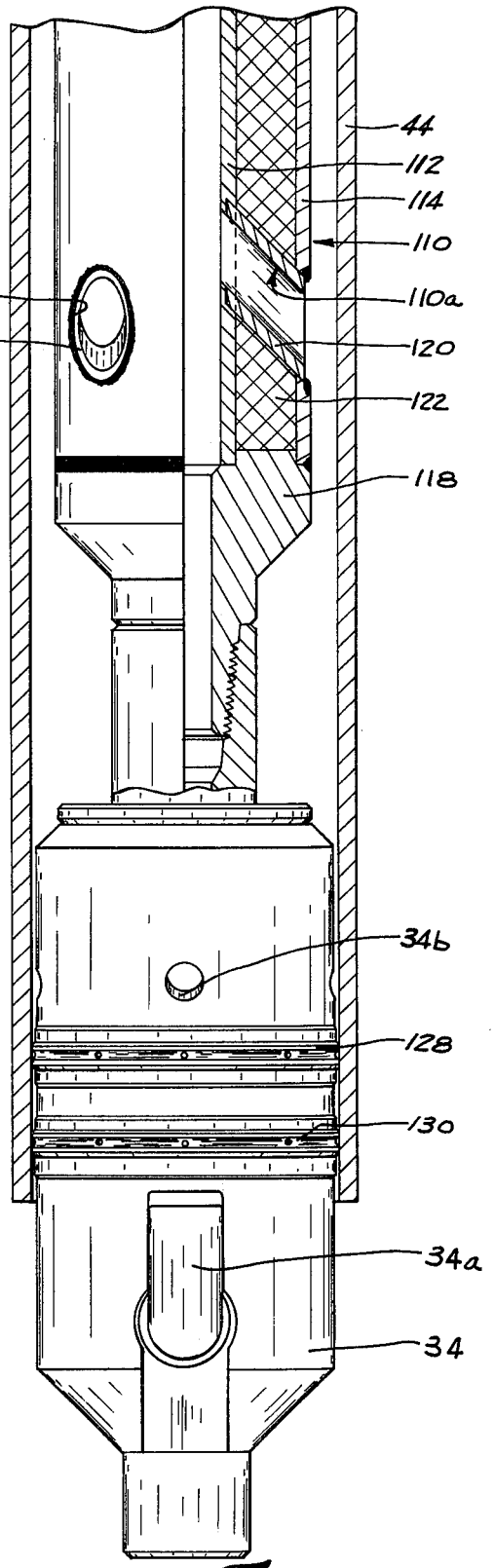
Fig. 7B

MOBILE DRILLING APPARATUS

BACKGROUND OF THE INVENTION

1. Field of the Invention

The present invention relates to drilling apparatus. More particularly, the present invention pertains to mobile drilling apparatus for operation on unfavorable terrain and for drilling at various angles with respect to the surface.

2. Description of Prior Art

Current practices in drilling holes in the ground employ a variety of apparatus. In particular, relatively shallow holes for such purposes as setting pilings or placing charges for seismic exploration may be drilled by a pile driver or by conventional well-drilling equipment. Where many such holes must be drilled, such as the case where pilings to support a pipeline are to be positioned, the drilling equipment must be frequently moved to new drilling sites. The usual method of moving a drilling rig is by "skidding," or by utilizing a rig mounted on a truck. Such a drilling operation requiring extensive movement of the equipment between multiple drilling sites can be impractical, however, or even virtually impossible, with such conventional drilling rigs where the terrain is rough, marshy or icy. In cases where the climate is extreme, as much of the total operation as possible must be capable of being performed in a sheltered environment. Furthermore, the drilling apparatus must be capable of drilling holes at various angles with respect to the surface, as needs dictate.

SUMMARY OF THE INVENTION

The present invention is a self-propelled drilling apparatus capable of operating on uneven, soft, or icy terrain, and of drilling holes at various angles with respect to the terrain surface. Drilling equipment is supported by a mast, or derrick, mounted on a base. The base is divided into two elements which are connected by a flexible joint that permits orientation of one such element with respect to the other at various angles about two mutually orthogonal axes. One base element is supported by powered treads used to propel the apparatus over rough, marshy, or icy terrain. The other base element supports the mast. A hole may be drilled over a range of angles, regardless of whether the tread-supported base element is level or at some angle with respect to the horizontal.

The drilling equipment may include a suction device for removing material disengaged from the ground by the drilling process. Also, the mast, or derrick, may be constructed with a hinge joint to permit folding back over the base for ease in transportation.

Prior art mobile drilling devices lack one or more of the features which distinguish the present invention. The U.S. Pat. Nos. 2,869,826 and 3,867,989, to Thornburg and to Hisey et al, respectively, disclose mobile drilling rigs designed to drill only at a right angle relative to their respective bases. The drilling devices shown in the U.S. Pat. Nos. 3,181,630 and 3,198,263, to Coburn and to Reischl, respectively, provide for drilling at various angles, relative to the base, within a single plane only. However, the base of the Coburn device is rotatable 360° on the crawler support frame which supports the treads, or crawlers, that are used to position the drilling device.

BRIEF DESCRIPTION OF THE DRAWINGS

FIGS. 7A and 7B are side elevations, in partial section, of the suction device and an underreamer;

DESCRIPTION OF PREFERRED EMBODIMENTS

Figure 1:
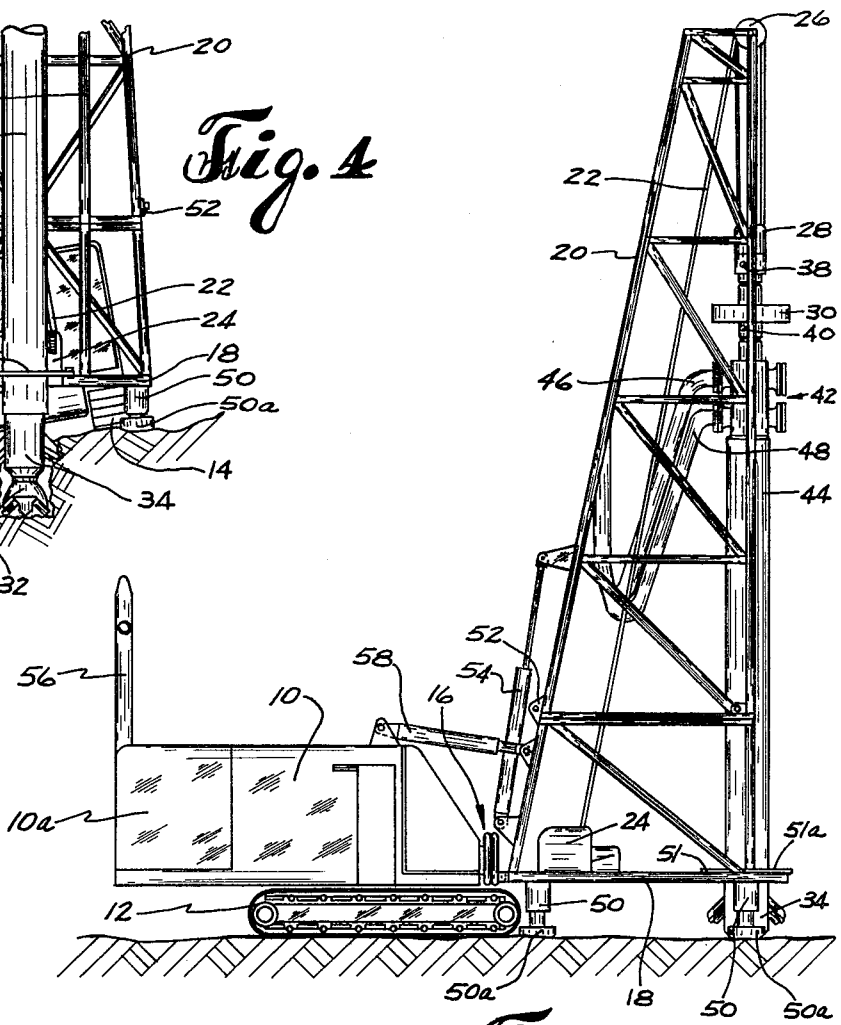
FIG. 1 is a side elevation of one embodiment of the present invention featuring a foldable derrick and a suction device.
Figure 2:
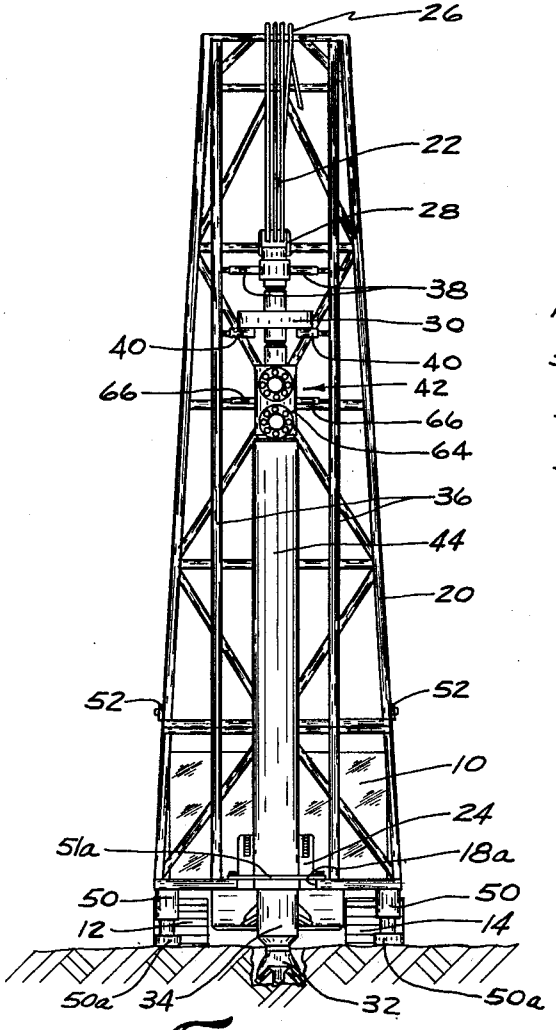
FIG. 2 is an end elevation of the apparatus shown in FIG. 1.

A self-propelled drilling apparatus of the present invention, featuring a foldable mast, or derrick, and a suction device, is illustrated in FIGS. 1 and 2. A first base element 10 is constructed in the form of a cab mounted on continuous tread systems 12 and 14. The cab 10 contains controls for operating the drilling apparatus, as well as engines and power supplies (none shown) for performing certain of the drilling operation functions, including running the tread systems 12 and 14 to propel the drilling apparatus. An extension of the cab **10*a* extends beyond the tread systems 12 and 14** and houses some of the aforementioned equipment.

A flexible base joint, shown generally at 16 and described in detail hereinafter, connects the first base element 10 with a second base element 18 in the form of a platform. A derrick 20 is fixed to the second base element 18. A cable 22, extending from a drawworks 24, which is also supported by the second base element 18, passes over a crown block 26 located at the top of the derrick 20, and extends down to a traveling block 28. A rotary power swivel 30 is supported by the traveling block 28, and is used to drill holes by turning drill bits, in the form of a pilot bit 32 and a weight-set underreamer 34, which are suspended below the power swivel. A pair of rails 36 extend along the front of the derrick 20. Pairs of arms 38 and 40 extend outwardly from the traveling block 28 and power swivel 30, respectively, and ride against the rails 36 to prevent rotation of the traveling block and power swivel when the power swivel is rotating the pilot bit 32 and underreamer 34. The rotary power swivel 30 may be of any conventional design, and powered, for example, electrically or hydraulically by an appropriate source (not shown).

A suction device, shown generally at 42 and described in detail hereinafter, is supported by the rotary power swivel 30, and extends downwardly inside a casing member 44 below which the pilot bit 32 and underreamer 34 are shown protruding. The casing member 44 is to be inserted into the hole drilled by the drilling apparatus. Flexible hoses 46 and 48 extend from the suction device at 42 to a position on the back of the derrick 20 where they are supported, then to a fluid circulating, or pumping, system (not shown), whose function is described hereinafter.

Figure 4:
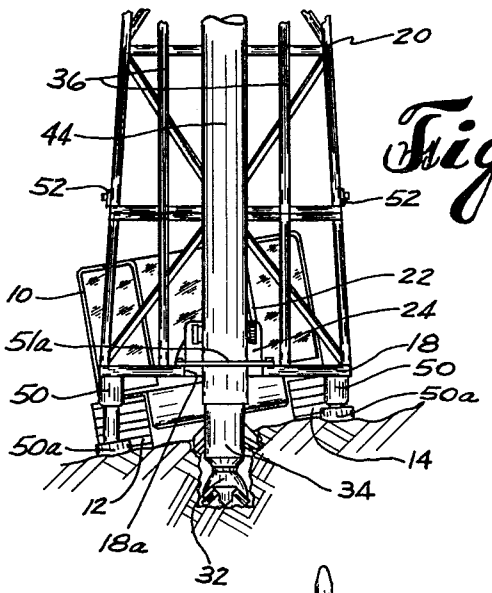
FIG. 4 is a partial end elevation, similar to FIG. 2, showing a vertical hole being drilled on a slope.
Figure 3:
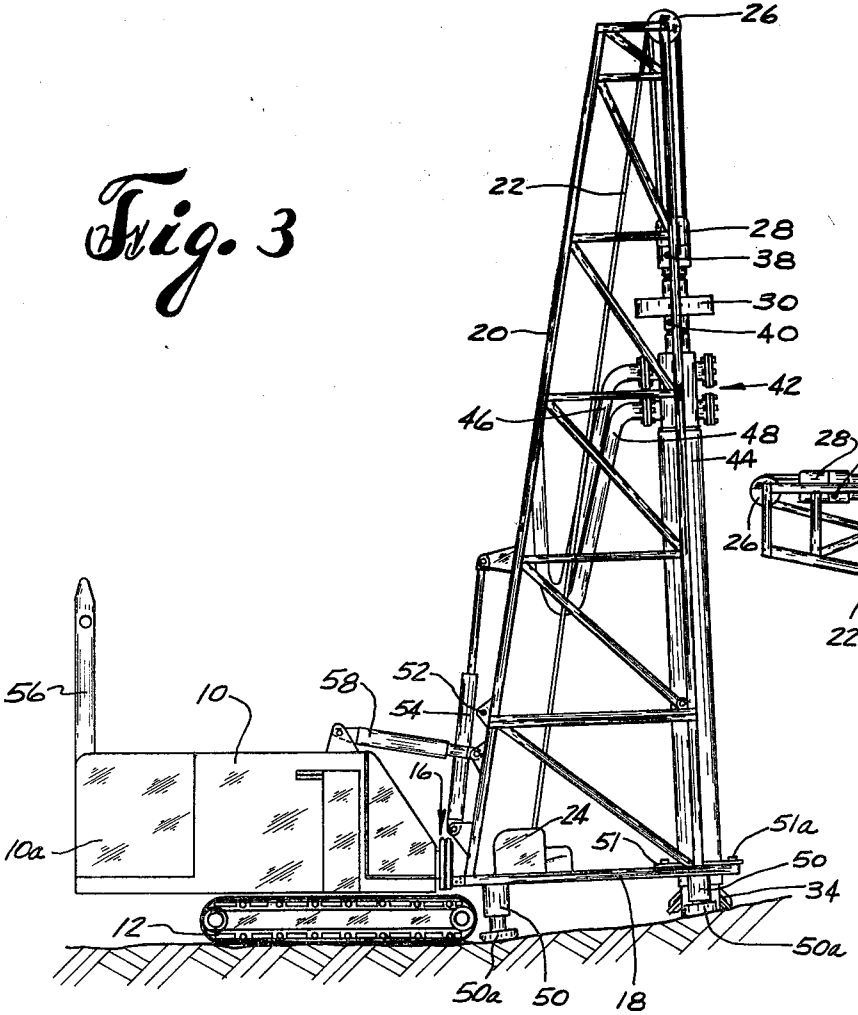
FIG. 3 is a side elevation, similar to FIG. 1, showing the apparatus being used on uneven terrain.

Four adjustable legs 50 extend downwardly from the bottom of the second base element 18, and are used to support the second base element during hole-drilling activity. Each leg 50 is in the form of a fluid pressure piston-and-cylinder assembly which may be individually adjusted for the desired amount of extension. The piston of the leg 50 may then be mechanically locked in place. Each leg 50 ends in a foot 50*a* mounted on a flexible joint (not visible) to accommodate the leg being set at some angle over a range of angles with respect to the immediate ground surface. Typical situations are illustrated in FIGS. 3 and 4 wherein the drilling apparatus is shown positioned facing an upward slope, and on a lateral incline, respectively. In FIG. 3, the first base element 10 is essentially horizontal, while the second base element 18 is tilted upwardly on the flexible base joint at 16, and is supported by the legs 50. The derrick 20 is thus tilted at a slight angle to the vertical for drilling a hole in the slope at such angle. In FIG. 4, the second base element 18 is essentially horizontal while the first base element 10 is tilted in line with the slope. The legs 50 are adjusted to accommodate the uneven ground while maintaining the second base element 18 essentially horizontal, and, consequently, the derrick 20 essentially vertical. The drilling apparatus is thus in a configuration to drill a vertical hole, which is shown started in FIG. 4.

Figure 5:
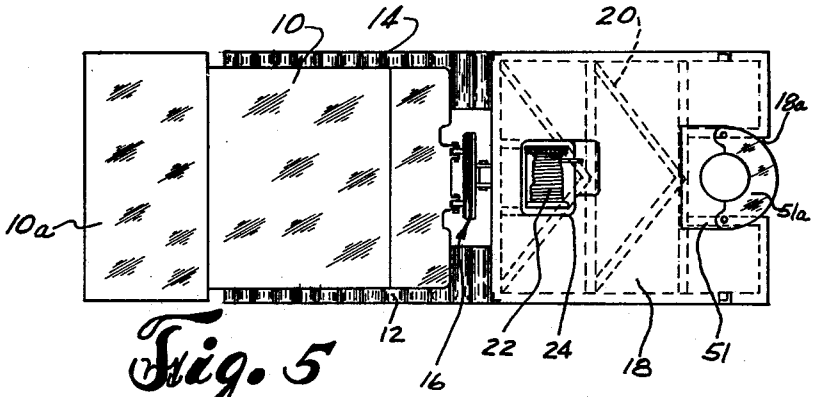
FIG. 5 is a plan view of the base elements, base joint and drawworks of the apparatus shown in FIGS. 1 through 4.

The leading edge of the second base element 18 features a recess 18*a* that accommodates the casing member 44. As best seen in FIG. 5, a collar assembly 51 is fixed to the second base element 18 to form a drilling guide positioned over the recess 18*a*. The collar assembly 51 is constructed with a removable latch 51*a* which can be swung open or removed altogether to permit swinging a casing member 44 into or out of the aperture formed by the otherwise closed collar assembly.

Figure 6:
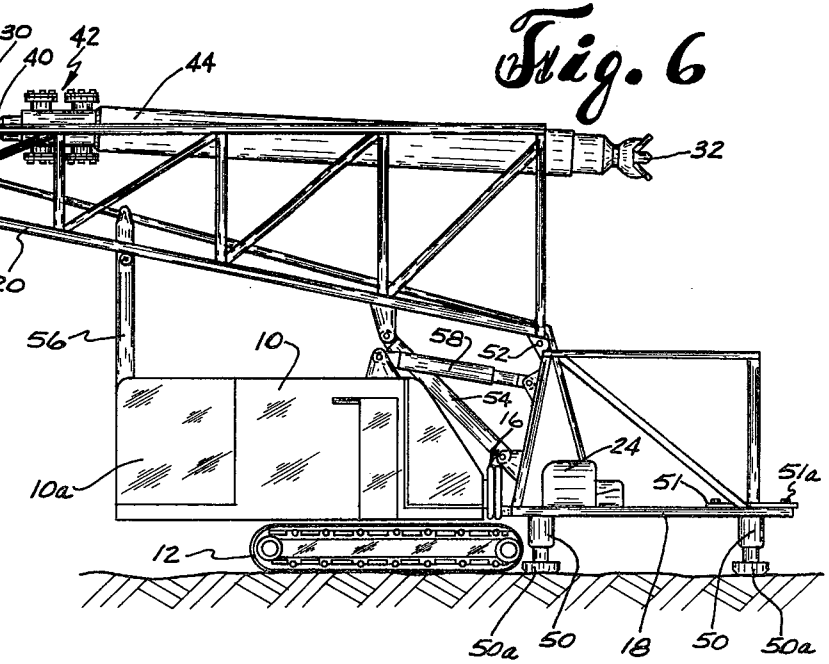
FIG. 6 is a side elevation showing the derrick in a folded position.

The derrick 20 is constructed in two parts joined by a pair of hinges 52. A pair of fluid pressure piston-and-cylinder assemblies 54 (only one visible) link the two portions of the derrick 20. Operation of the pair of cylinder assemblies 54 from a common source of fluid pressure (not shown) permits the derrick 20 to be folded on the hinges 52 back over the first base element 10 as illustrated in FIG. 6. A brace 56, mounted on the cab extension 10*a* of the first base element 10, provides support for the derrick in the folded position. When the derrick 20 is folded back over the first base element 10, the drilling equipment suspended by the cable 22 is prevented from falling against the back of the derrick by appropriate cross bars in the derrick structure itself. The folded position as illustrated in FIG. 6 is used primarily when the drilling apparatus is being moved over relatively large distances with no immediate need for drilling holes. The folding capability of the derrick 20 is also useful in passing the drilling apparatus under overhead obstructions that are closer to the ground than the height of the derrick in its upright position shown in FIGS. 1 through 4.

When the legs 50 are retracted so that the feet 50*a* are not to be in contact with the ground, the second base element 18, along with the equipment it supports, is supported by a pair of fluid pressure piston-and-cylinder assemblies 58 which extend from the top of the cab constructed as the first base element 10 to the back of the derrick 20 as shown in FIGS. 1, 3, and 6. The cylinder assemblies 58 (only one visible) may be operated from a common fluid pressure source (not shown); however, the two cylinder assemblies 58 are capable of being operated individually in order that configurations may be achieved such as that shown in FIG. 4 in which the first base element 10 is tilted with respect to the second base element 18 about a common longitudinal axis, requiring different extensions of the two cylinder assemblies 58. With the feet 50*a* off of the ground, the cylinder assemblies 58 thus support the second base element 18 and the equipment situated thereon while the drilling apparatus is in transit, whether the derrick 20 is in the erect configuration of FIGS. 1 through 4 or the folded position of FIG. 6.

FIGS. 7A and 7B illustrate the suction device shown generally at 42 in FIGS. 1 through 3, and 6. A drive shaft 30*a* from the rotary power swivel 30 is threadedly joined to a coupler 60. A flow path sleeve 62 is threadedly joined to the coupler 60, and extends downwardly within a union collar 64. As seen in FIG. 2, the union collar 64 is held against rotation by a pair of arms 66 extending outwardly to contact the rails 36. The sleeve 62 rotates within the collar 64 as the output shaft 30*a* is rotated by the rotary power swivel 30. The threaded joints between the output shaft 30*a* and the coupler 60, and between the coupler 60 and the sleeve 62 tend to tighten as the output shaft is rotated in a right-hand sense.

A ring 68 is welded to the interior of the flow path sleeve 62 and supports a mandrel 70 centered within the sleeve. The outer surface of the sleeve 62 features two annular grooves 62*a* and 62*b* which form passageways around the sleeve within the union collar 64. A pair of ports 62*c* and 62*d* pass through the wall of the sleeve 62 within the groove 62*a*; a similar pair of ports 62*e* and 62*f* pass through the sleeve wall within the groove 62*b*. The union collar 64 is equipped with four flanged terminals 64*a*, 64*b*, 64*c*, and 64*d*. The terminals 64*a* and 64*b* are positioned to align with the groove 62*a* in the flow path sleeve 62; similarly, the terminals 64*c* and 64*d* are aligned with the groove 62*b*. As a result, the groove 62*a* and the ports 62*c* and 62*d* cooperate with the terminals 64*a* and 64*b* to provide fluid passageways from outside of the union collar 64 to the interior of the flow path sleeve 62. Similarly, the groove 62*b* and the ports 62*e* and 62*f* cooperate with the terminals 64*c* and 64*d* to provide fluid passageways to the interior of the flow-path sleeve 62 at a lower position below the ring 68. Within the flow path sleeve 62, the ring 68 and the mandrel 70 serve to divide the interior of the sleeve into two regions, indicated in FIG. 7A as areas A and B. The ports 64*a* and 64*b* communicate with the interior area A of the flow path sleeve 62, and the ports 64*c* and 64*d* communicate with the interior area B. It will be appreciated that the integrity of the passageways into the areas A and B from the terminals 64*a*, 64*b*, and 64*c*, 64*d*, respectively, are preserved regardless of the rotational orientation of the flowpath sleeve 62 with respect to the union collar 64, since the terminals 64*a* and 64*b* are in continuous communication with the ports 62*c* and 62*d* through the groove 62*a*, and the terminals 64*c* and 64*d* are in continuous communication with the ports 62*e* and 62*f* through the groove 62*b*.

O-rings 72, 74, 76, and 78 set in appropriate grooves, provide rotary fluid seals between the flow path sleeve 62 and the union collar 64. A plurality of ball bearings 80 (only two visible) ride between an inner annular raceway 82 and an outer annular raceway 84 to act as rotational bearings between the flowpath sleeve 62 and the union collar 64 at the top of the union collar. A similar set of ball bearings 86 (only two visible) between raceways 88 and 90 act as rotational bearings at the bottom of the union collar 64. The union collar 64 rests on the lower raceways 88 and 90, cushioned by thrust bearings 92. The inner lower raceway 88 in turn is prevented from moving downwardly with respect to the flow path sleeve 62 by a pair of splines 62*g* on the surface of the sleeve. Thus, the union collar 64 is supported by the flowpath sleeve 62. The upper raceways 82 and 84 rest on thrust bearings 94. A ring 96 covers the raceways 82 and 84, and extends outwardly to rest on the top of the union collar 64. The ring 96 is fitted with an O-ring seal 98 which lies against the top of the union collar 64. A resilient packing gland 100 fits inside an annular trough formed between the ring 96 and the flow path sleeve 62 to form an additional seal.

Extending downwardly from the mandrel 70, and threadedly joined thereto, is a leaded drill collar shown generally at 110 in FIGS. 7A and 7B. The drill collar at 110 is constructed primarily of a generally tubular inner sleeve 112 and a generally tubular outer sleeve 114. The inner sleeve 112 and the outer sleeve 114 are held in concentric configuration by an upper spacer ring 116 and a lower spacer ring 118, both welded to the sleeves 112 and 114. Since the drill collar at 110 extends downwardly from the mandrel 70, which distinguishes the separate areas A and B within the flow path sleeve 62, the drill collar maintains the division between the areas A and B below the sleeve 62. A plurality of passageways 110*a* (only two visible) communicate through the drill collar at 110 between the downward extensions of areas A and B that are divided by the drill collar. The drill collar passageways 110*a* are defined by tubing members 120 welded in place in appropriate throughbores in the sleeves 112 and 114. The passageways 110*a* are constructed so as to slope upwardly as they progress radially inwardly toward the center of the drill collar at 110. The generally annular region between the inner sleeve 112 and the outer sleeve 114 of the drill collar at 110, exclusive of the portions occupied by the tubing members 120, is filled with lead 122. The lead 122 serves to increase the weight of the drill collar at 110 to aid in the drilling operation described hereinafter.

The weight set underreamer 34 is threadedly joined to the bottom of the lower spacer ring 118. A detailed description of a typical weight set underreamer is included in U.S. Pat. No. 3,633,690. The pilot bit 32 extends downwardly from the weight set underreamer 34. Area A continues downwardly within the weight set underreamer 34 and the pilot bit 32 which contains intake means (not shown) from the region below the pilot bit into the region A. The underreamer 34 features a pair of cutters 34*a* (only one visible in FIG. 7B) that are pivot-mounted to either fold inwardly to lie within the outer cylindrical boundary of the underreamer housing, or swing outwardly to enlarge the diameter of the hole cut by the pilot bit 32 below. Four ports 34*b* (only three visible in FIG. 7B) provide communication between the bottom region of area B to the region of area A extending down into the underreamer 34.

The exterior boundary of the region B below the flow path sleeve 62 is defined by the casing member 44. The casing member 44 is frictionally joined to a slip ring 124 surrounding the flow path sleeve 62 below the union collar 64. The slip ring 124 features four downwardly-projecting slips 124*a* (only one visible). The radially outer surface of each slip 124*a* is lined with laterally oriented gripping edges. The lower inner surface of each slip 124*a* is sloped upwardly and inwardly. Four ribs, or expanders, 62*h* (only one visible) protrude radially outwardly from the exterior surface of the flow path sleeve 62. The radially outer surface of each rib 62*h* is sloped to fit against the inner sloped surface of a slip 124*a*.

The two splines 62*g* of the flow path sleeve fit within two key recesses 124*b* of the slip ring 124. Each key recess 124*b* is arcuately wide enough to permit the flow path sleeve 62 to be rotated approximately 35° with respect to the slip ring 124 before the sleeve is rotationally locked to the ring 124. Each slip 124*a* and each rib 62*h* are approximately 30° in arcuate width. Rotation of the flow path sleeve 62 by operation of the power swivel 30 in a right-hand sense with respect to the slip ring 124 moves a rib 62*h* radially behind each slip 124*a*. Continued rotation of the flow path sleeve 62 in a right-hand sense causes the slip ring 124 to rotate also, with the ribs 62*h* aligned with the slips 124*a*, due to the locking of the splines 62*g* at the ends of the key recesses 124*b*. Rotation of the flow path sleeve 62 in a left-hand sense with respect to the slip ring 124 moves the ribs 62*h* clear of the slips 124*a* until the splines 62*g* lock against the other ends of the key recesses 124*b*. Continued rotation of the flow path sleeve 62 in a left-hand sense causes rotation of the slip ring 124 also, with the ribs 62*h* clear of the slips 124*a*.

The slip ring 124 may be moved longitudinally along the flow path sleeve 62, from an upper extreme with the top of the slip ring against the union collar 64 and lower raceways 88 and 90, to a lower position with the inner sloped surfaces of the slips 124*a* against the ribs 62*h* as shown in FIG. 7A. When the ribs 62*h* are not rotationally aligned with the slips 124*a*, the slip ring 124 may reach a slightly lower position (not shown).

The casing member 44 is joined to the slip ring 124 by the gripping action of the slips 124*a* against the inner surface of the casing member. This gripping action is effected when the ribs 62*h* are aligned with the slips 124*a*, and the slip ring is in the lower position, relative to the flow path sleeve 62, shown in FIG. 7A. Then, the slopes of the ribs 62*h*, acting on the sloped surfaces of the slips 124*a*, force the slips radially outwardly against the casing member 44. The lateral edges of the slips 124*a* thus grip the casing member. When the flow path sleeve 62 is then raised by action of the cable 22, the ribs 62*h* lift the slips 124*a*, which have sufficient frictional contact with the casing member 44 to lift it.

In order to connect the casing member 44 to the drilling equipment by the slip ring 124, the flow path sleeve 62, and all equipment supported below the flow path sleeve, are inserted into the casing member. The casing member 44 is moved along the flow path sleeve 62 until the top of the casing member is stopped by a downwardly-facing annular shoulder 124c at the top of the slip ring 124. The ribs 62h are rotationally aligned with the slips 124a as described hereinbefore by operation of the power swivel 30. The cable 22 is then operated to raise the flow path sleeve 62, causing the ribs 62h to move up under the slips 124a to force the slips into gripping engagement with the casing member 44.

To release the casing member 44 from the drilling equipment, the flow path sleeve 62 is permitted to move a short distance down into the casing member 44 from the position shown in FIG. 7A. This may be done by gripping the casing member 44 with a gripping device (not shown) located, say, on the second base element 18 while the cable is operated to lower the flow path sleeve 62. The power swivel 30 then rotates the flow path sleeve 62 in a left-hand sense to clear the ribs 62h from behind the slips 124a. With no ribs 62h behind them to press them against the casing member, the slips 124a are not sufficiently rigid to sustain a gripping force against the casing member 44. Thus, the cable 22 may be operated to lift the flow path sleeve 62, and all equipment supported thereby, up and out of the casing member 44 as the slips 124a slide against the inner surface of the casing member.

A resilient packing seal 126 is fitted in an appropriate groove in the lower outer surface of the flow path sleeve 62, and forms a slidable, rotatable fluid seal between the casing member 44 and the sleeve 62. The outer region B that begins within the flow path sleeve 62 is thus continued downwardly between the casing member 44 and the leaded drill collar at 110. A pair of annularly ribbed sealing rings 128 and 130 surrounding the weight set underreamer 34 below the ports 34b define the lower limit of the area B between the weight set underreamer and the casing member 44.

Figure 9:
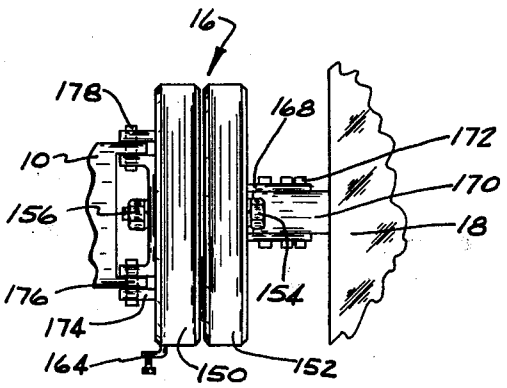
FIG. 9 is a plan view of the flexible base joint shown in FIG. 8.
Figure 8:
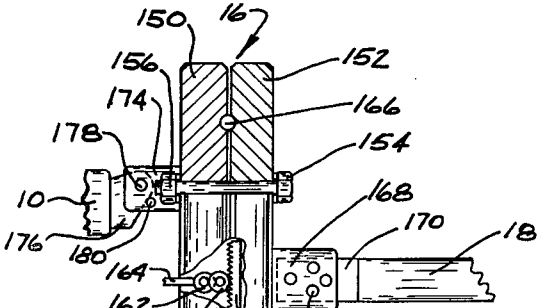
FIG. 8 is a cut-away side elevation, in partial section, showing the flexible base joint.

The flexible base joint at 16 is shown in detail in FIGS. 8 and 9. A pair of discs 150 and 152 are joined by a nut 154 passing through the discs along their common axis of cylindrical symmetry. The nut 154, which is held in place by a bolt 156, serves as an axle about which the discs 150 and 152 may rotate relative to each other.

As seen in the cut-away in FIG. 8, the mutual rotation of the discs 150 and 152 is controlled by a rack 158 and pinion 160. The curved rack 158 is mounted on the forward disc 152 while the pinion 160 is mounted within the rearward disc 150. A gear assembly 162 links the pinion 160 with an external crank 164. Rotation of the crank 164 thus causes operation of the rack 158 and pinion 160 combination to rotate the forward disc 152 with respect to the rearward disc 150. A plurality of ball bearings 166 (only one shown) ride in appropriate grooves in the faces of the discs 150 and 152 to facilitate their mutual rotation.

The front of the forward disc 152 features a clevis 168. A box beam 170 extends from the second base element 18 into the clevis 168, and is rigidly fastened thereto by bolts 172. A pair of clevises 174, fixed to the back of the rearward disc 150, meshes with a pair of tongues 176 that extend from the first base element 10. The tongues 176 are held to the clevises 174 by a pair of pins 178. The combination of the clevises 174, tongues 176, and pins 178 acts as a hinge to permit rotational motion of the discs 150 and 152, with respect to the first base element 10, about an axis defined by the common axis of cylindrical symmetry of the pins 178.

The flexible base joint at 16 allows the second base element 18 to be oriented at any desired angle, with respect to the first base element 10, about the axis defined by the nut 154, and about the axis defined by the pins 178. As can be seen in FIG. 8, the nut 154 and the pins 178 lie along mutually orthogonal lines which intersect at a point to the rear of the rearward disc 150. By operation of the cylinder assemblies 58, the second base element 18 may be tilted about the pins 178 of the flexible base joint at 16, and, with the additional operation of the crank 164, may be rotated about the nut 154. In this way, the flexible base joint at 16 is a means whereby the second base element 18 may be oriented with respect to the first base element 10 over a range of angles about two mutually orthogonal axes to accommodate uneven terrain and to act as a drilling guide to determine the direction of hole drilling.

As can be seen in FIG. 8, two locking pins 180 (only one visible) may be inserted in appropriate holes in the clevises 174 to act as stops against the forward, lower surfaces of the tongues 176 to prevent downward rotation of the second base element 18 about the pins 178. This may be done whenever the feet 50a are raised off of the ground, as for example when the drilling apparatus is being moved.

In a typical operation, the mobile drilling apparatus is driven to a drilling site with the derrick 20 in the folded position shown in FIG. 6, and the second base element 18 supported by the piston-and-cylinder assemblies 58 with the feet 50a held up off of the ground and the locking pins 180 in place in the clevises 174. The drilling apparatus is positioned with the collar assembly 51 centered over the point at which a hole is to be drilled. The piston-and-cylinder assemblies 54 are activated to raise the derrick 20 to its erect orientation as shown in FIGS. 1 through 4. When this is done, the pilot bit 32 and underreamer 34 pass through the collar assembly 51, and are positioned over the intended drilling point. The locking pins 180 are removed. The cylinder assemblies 58 and the crank 164 are adjusted to achieve the desired orientation of the second base element 18, and the legs 50 are adjusted to set the feet 50a on the ground to support the second base element. The rotary power swivel 30 is then operated to rotate the pilot bit 32 and underreamer 34 to drill the hole.

As the output shaft 30a of the rotary power swivel 30 is turned, the flow path sleeve 62 and the mandrel 70 also rotate, causing the drill collar 10 to rotate. Thus, the underreamer 34 and the pilot bit 32, which are suspended from the drill collar 110, are caused to turn. As the pilot bit 32 and underreamer 34 penetrate the ground, the drawworks 24 is operated to lower the traveling block 28 on the cable 22, thus permitting the weight of the drilling equipment suspended from the traveling block, particularly the leaded drill collar 110, to force the pilot bit and underreamer downwardly. As the pilot bit 32 and underreamer 34 move down into the ground, the casing member 44 is urged upwardly relative to the flow path sleeve 62, permitting the underreamer cutters 34a to pivot outwardly into cutting position. Details of the pivoting of cutters in a typical weight set underreamer, in response to force applied to the underreamer as here by the weight of the leaded drill collar 110, may be found in U.S. Pat. No. 3,633,690. The hole that is drilled by the pilot bit 32 is widened by the cutters 34a to a diameter greater than that of the casing member 44. The casing member 44 is then able to move down into the hole following the underreamer 34.

Two of the union collar flange terminals, such as 64b and 64d, are sealed, in preparation for drilling, by plates (not shown) fastened over the outer openings of the respective terminals. Thus, only one flanged terminal 64a permits access to the interior area A by way of the groove 62a, and only one flanged terminal 64c permits access to the interior area B by way of the groove 62b. Hose 46 is connected to the flanged terminal 64a, and hose 48 is connected to the flanged terminal 64c. During the actual drilling of the hole, while the pilot bit 32 and underreamer 34 are being rotated by the rotary power swivel 30, fluid is pumped into the interior area B by way of the hose 48. This fluid circulates downwardly to the lower region of the drill collar 110 and the underreamer 34. It then moves into the interior area A by way of the passageways 110a, defined by the tubing members 120, and the ports 34b in the underreamer 34. As drilling progresses, material disengaged from the ground by action of the pilot bit 32 and underreamer 34 passes up through the pilot bit and underreamer into the lower extension of the interior area A within the underreamer. This material is drawn upwardly by the suction effect caused by the circulation of the fluid, originally pumped into the interior area B through the hose 48, as this fluid passes through the passageways 110a and ports 34b into and up along the area A. This mixture of pumped fluid and cut material is then drawn, by the pumping system (not shown), upwardly in the interior area A through the sleeve 112 of the drill collar at 110 and the mandrel 70. At the top of the flowpath sleeve 62, the mixture of pumped fluid and cut material passes through the ports 62c and 62d into the groove 62a, and through the flanged terminal 64a into the flexible hose 46. The cut material is then separated from the pumped fluid and discarded or otherwise dealt with, and the pumped fluid is recirculated back through the hose 48 to the interior area B as the circulation process continues. This circulation, or suction, process thus serves as a means to remove material cut from the ground by the drilling process.

As the hole is being drilled, and the drilling equipment suspended by the traveling block 28 is lowered on the cable 22 by operation of the drawworks 24, the casing member 44 passes through the collar assembly 51. The constraint which the collar assembly 51 thus exercises on the casing member 44 acts to guide the drilling equipment, particularly the pilot bit 32 and the underreamer 34, in the direction in which the hole is desired to be drilled. Once the hole has been drilled to the desired depth, all of the drilling equipment suspended from the traveling block 28 may be raised above the hole, leaving the hole empty. The mobile drilling apparatus may then be moved on to the next drilling site. However, if desired, the casing member 44 may be left in the drilled hole to line the hole. This may be done by the simple task of disengaging the casing member 44 from the slip ring 124, as described hereinbefore, while the casing member is still located in the drilled hole. The cable 22 is operated to raise the traveling block 28 and the drilling equipment suspended thereby a few inches. A gripping device (not shown), mounted on the second base element 18, is used to hold the casing member 44 while the cable 22 lowers the flow path sleeve 62 a few inches to free the slips 124a from gripping engagement with the casing member. Once the casing member has been completely disengaged from the slip ring 124, the drilling equipment still suspended from the traveling block 28 may be raised, leaving the casing member 44 in the drilled hole. Whether the casing member 44 is to be left in the hole or removed, as the underreamer 34 is raised relative to the casing member just a short distance and the weight of the leaded drill collar at 110 is removed from the underreamer, the cutters 34a are forced back into their folded position as shown in FIG. 7B with the casing member riding along the outer surfaces of the cutters.

Once the drilling equipment supported by the traveling block 28 has been raised sufficiently for the pilot bit 32 to clear the surface of the ground, the piston-and-cylinder assemblies 58 may be actuated to support the second base element 18, and to allow the legs 50 to be retracted to raise the feed 50a off of the ground. The mobile drilling apparatus may be driven to another site in this condition, and positioned with the collar assembly 51 centered on the next desired drilling point. The drilling operation may then be repeated as described hereinbefore. If the casing member 44 had been left to line the previously drilled hole, a new casing member may be slipped onto the drilling equipment to be used in the next drilling operation. While this new casing member (not shown) is held in position around the leaded drill collar at 110, the slip ring 124 may be joined to the casing member by the slips 124a gripping the casing member due to the ribs 62h being wedged behind the slips as described hereinbefore.

When the drilling operation has been completed, the piston-and-cylinder assemblies 52 may be actuated to fold the top of the derrick 20 on the hinges 52 into the folded position shown in FIG. 6. With the folded derrick then resting on the brace 56, and the second base element 18 supported by the piston-and-cylinder assemblies 58 as well as the pins 180 in the clevises 174, the mobile drilling apparatus may be driven to a new drilling site.

FIGS. 10 through 16 illustrate another embodiment of the self-propelled drilling apparatus of the present invention. A first base element 210, constructed as a cab having a rearward equipment-housing extension 210a, is supported by tread systems 212 and 214 which are used to propel the drilling apparatus. A flexible base joint, shown generally at 216 and described in detail hereinafter, connects the first base element 210 with a second base element 218 in the form of a platform. A mast 220 is pivotally joined to the forward side of the flexible joint at 216. A cable 222, operable by a standard powered drum 223 (FIG. 13), extends up the mast 220 to a crown block 226 located at the top of the mast. The cable 222 then passes over the crown block 226 to support a traveling block 228. A rotary power swivel 230 is suspended from the traveling block 228. Additional drilling equipment, including a leaded drill collar 231, a pilot bit 232, and a weight-set underreamer 234 with pivotal cutters 234a, is rotatably suspended from the rotary power swivel 230 by the output shaft 230a of the power swivel. The drill collar 231 connects the underreamer 234 with the output shaft 230a and serves to weight the pilot bit 232 and underreamer 234 during the drilling process. A pair of spreaders 235, extending laterally from the top of the mast 220, guide a pair of rails 236 which extend downwardly to the second base element 218 where they are attached by flexible joints 237. Pairs of arms 238 and 240 extend outwardly from the traveling block 228 and power swivel 230, respectively, and ride against the rails 236 to prevent rotation of the traveling block and power swivel when the power swivel output shaft 230a is rotating the pilot bit 232 and underreamer 234. Each rail 236 passes through a hole at the outward end of the corresponding spreader 235. As the mast 220 is tilted toward or away from the cab of the first base element 210, as explained hereinafter, the rails 236 tilt accordingly, with the spreaders 235 silding along the rails.

Figures 10, 11, 12:
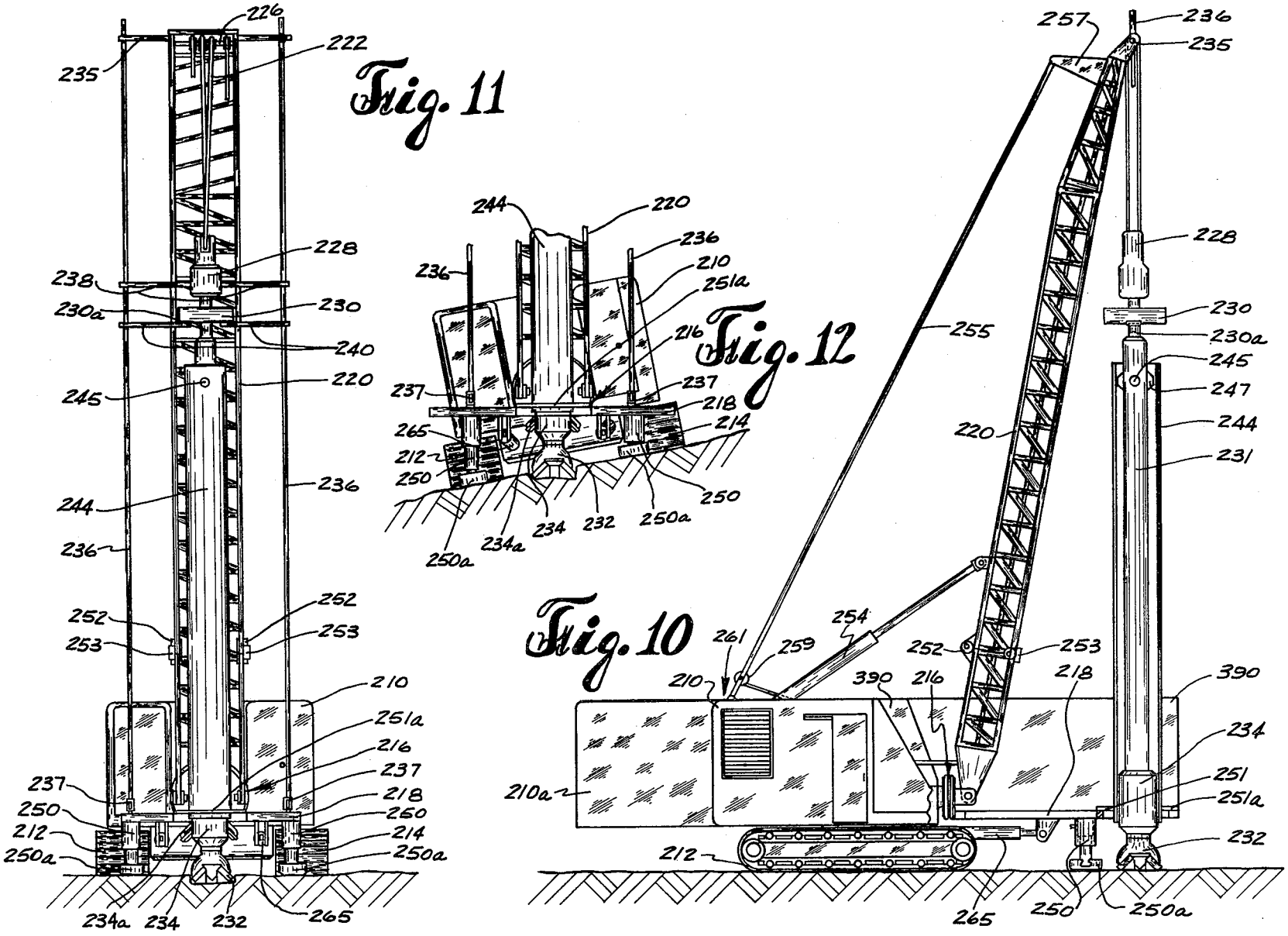
FIG. 10 is a side elevation, in partial section, of another embodiment of the present invention, featuring a foldable mast.
FIG. 11 is an end elevation of the apparatus shown in FIG. 10.
FIG. 12 is a partial end elevation, similar to FIG. 11, illustrating the use of the apparatus on a slope.

The leaded drill collar 231 is surrounded by a casing member 244 which is secured to the top of the drill collar by a nut 245. The casing member 244 may also be held in place by any other suitable means, such as a slip assembly similar to the slip ring 124 and ribs 62*h* discussed hereinbefore, located at the top of the drill collar 231. The casing member 244 serves the same purposes as the casing member 44 discussed hereinbefore, that is, to assist in guiding the pilot bit 232 and the underreamer 234 in the drilling process and, if desired, to be left behind to line the drilled hole. A plurality of wings 247 (only two shown) protrude from the drill collar 231 to contact the interior surface of the casing member 244 to facilitate the positioning of the casing member about the drill collar, and the removal of the drill collar when the casing member is left in the drilled hole. Two adjustable legs 250 extend downwardly from the bottom of the second base element 218. Each leg 250 is identical in construction and operation to the legs 50 discussed hereinbefore, including being equipped with a foot 250*a* mounted by a flexible joint to each leg 250. During the drilling process, the legs 250 and feet 250*a* support the second base element 218 in whatever orientation is desired, regardless of the orientation of the first base element 210. FIG. 12 illustrates the case in which the second base element 218 is positioned to effect the drilling of a vertical hole on a lateral slope while the first base element 210 assumes the angle of inclination of the slope.

Figure 13:
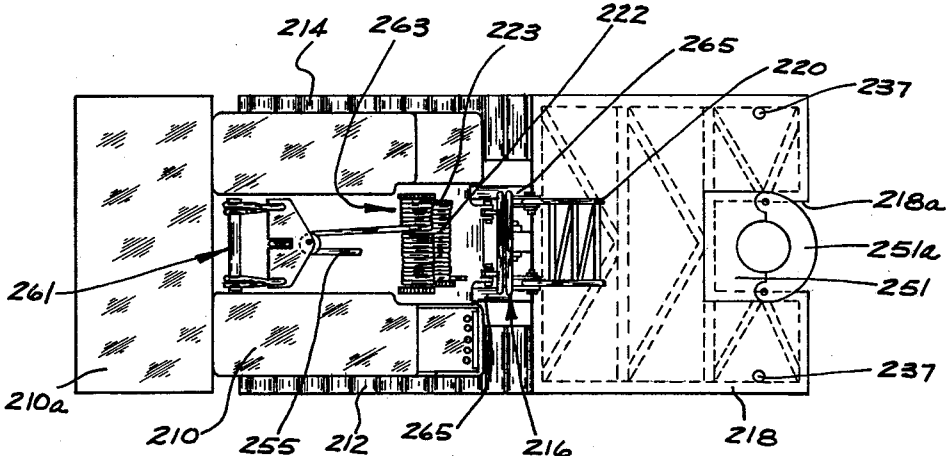
FIG. 13 is a plan view of the base elements, base joint and a cross section of the cable system of the apparatus shown in FIGS. 10 through 12.

As best seen in FIG. 13, the leading edge of the second base element 218 features a recess 218*a* that accommodates the casing member 244. A collar assembly 251 is fixed to the second base element 218 to form a drilling guide positioned over the recess 218*a*. A removable latch 251*a* forms the forward portion of the collar assembly 251, and can be opened or removed to permit the insertion or removal of a casing member into or out of the collar assembly.

The mast 220 is constructed in two parts joined by a pair of hinges 252 and fitted with fastening devices 253. A fluid pressure piston-and-cylinder assembly 254 links the upper portion of the mast 220 with the first base element 210. Operation of the cylinder assembly 254 permits the mast 220 to be folded on the hinges 252 back over the first base element 210. When the mast 220 is to be folded back over the first base element 210, the rails 236 are disengaged from the spreaders 235, and the drilling equipment suspended from the traveling block 228 is either removed from the traveling block or provision is made to lash such equipment to the upper portion of the mast as the mast is folded back. In its erect position as shown in FIGS. 10–12, the mast is locked by the fasteners 253 on the side opposite the hinges 252 to prevent the mast from folding accidentally.

With the mast 220 locked in its erect position, the cylinder assembly 254 may be used to alter the forward and rearward tilt of the mast. With flexible anchoring of the cylinder assembly 254 at both the end attached to the mast 220 and the end (not shown) attached to the first base element 210, the control of the forward and rearward tilt of the mast by the cylinder assembly 254 may be effected even though the angle of orientation of the second base element 218 differs from that of the first base element as shown, for example, in FIG. 12.

A cable 255 provides a backup system for supporting the mast 220 in its erect position. The cable 255 extends downwardly from an arm 257, protruding rearwardly from the top of the mast 220, to a sheave 259 mounted on a harness shown generally at 261. The harness at 261 serves to position the sheave 259 to permit the cable 255 to apply a restraining force to the mast 220 at an angle suitable for the cable 255 to effect appropriate leverage on the mast. As shown in FIG. 13, the cable 255 passes from the sheave 259 to a powered drum system, shown generally at 263, which is used to control the cable 255.

A pair of fluid pressure piston-and-cylinder assemblies 265 link the first base element 210 with the underside of the second base element 218. The cylinder assemblies 265 serve generally the same purpose as the cylinder assemblies 58 discussed hereinbefore. Thus, when the feet 250*a* are removed from the ground surface, the cylinder assemblies 265 operate to support the second base element 218 and the equipment supported thereon. The cylinder assemblies 265 may be operated in unison from a common fluid pressure source (not shown), but are capable of the necessary independent operation to rotate the second base element 218 with respect to the first base element 210 about the flexible joint at 216 as needed to achieve the desired drilling angle and to accommodate uneven terrain.

Figure 16:
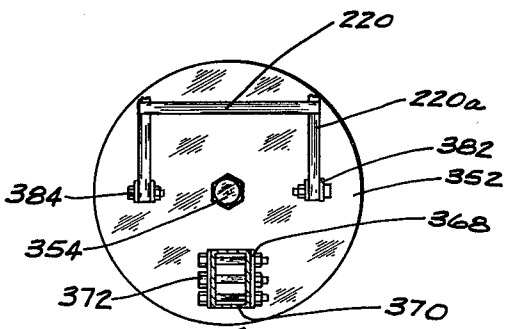
FIG. 16 is a partial vertical cross section taken along the line 16—16 of FIG. 14.
Figure 15:
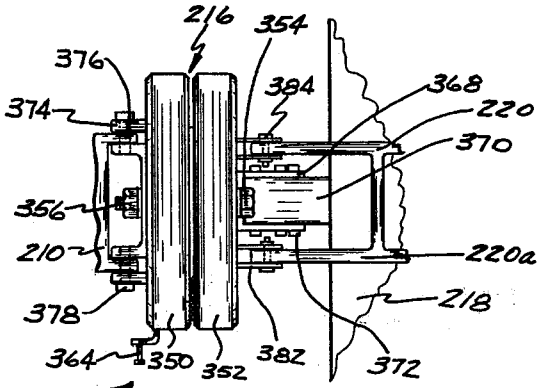
FIG. 15 is a plan view of the base joint shown in FIG. 14.
Figure 14:
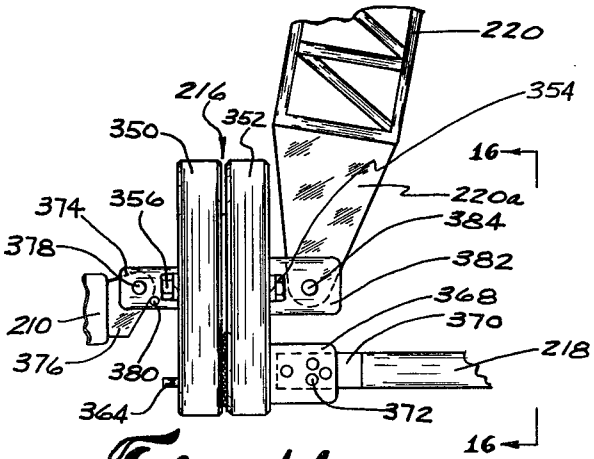
FIG. 14 is a partial side elevation illustrating the flexible base joint with the mast attached.

As can be appreciated by reference to FIGS. 14–16, the flexible base joint at 216 is similar to the joint at 16 described hereinbefore. A pair of discs 350 and 352 are held together by a bolt 354 and nut 356 positioned along the common axis of cylindrical symmetry of the discs. A rack and pinion linkage (not shown), operable by a gear assembly (not shown) and external crank 364, controls the rotation of the forward disc 352, about the axis defined by the bolt 354, relative to the rearward disc 350. A clevis 368 on the front of the forward disc 352 receives a box beam 370 extending rearwardly from the second base element 218. The box beam 370 is rigidly held within the clevis 368 by bolts 372. A pair of clevises 374, fixed to the back of the rearward disc 350, meshes with a pair of tongues 376 extending from the first base element 210. The tongues 376 are held to the clevises by a pair of pins 378. The pins 378 define a second axis, orthogonal to, and intersecting, the axis defined by the nut 354, about which the orientation of the second base element 218 may be varied relative to the orientation of the first base element 210. Two locking pins 380 (only one visible) may be inserted in appropriate holes in the clevises 374 to limit the rotation of the second base element 218 about the pins 378.

A pair of clevises 382, fixed to the front of the forward disc 352, receives a pair of feet 220*a* at the base of the mast 220. The mast feet 220*a* are held to the clevises by a pair of nut-and-bolt combinations 384. The mast 220 is thus able to be pivoted about the axis defined by the bolts 384 under the influence of the cylinder assembly 254. The pivot axis of the mast defined by the bolts 384 intersects the rotational axis defined by the bolt 354.

The flexible joint at 216 permits the second base element 218 to be rotated, relative to the first base element 210, about two mutually orthoganal axes: the axis defined by the bolt 354 and the axis defined by the pins 378. As the second base element 218 is rotated about the bolt 354, the mast 220 turns with the second base element. The clevises 382 which support the mast 220 also tilt with the second base element 218 about the pins 378.

However, the forward and backward tilt of the mast 220 may additionally be altered by rotation about the bolts 384 independently of the orientation of the second base element 218 about the pins 378. Consequently, the flexible base joint at 216 permits drilling at virtually any desired angle, and also makes it possible for the self-propelled drilling apparatus to negotiate uneven terrain.

In addition to the shelter supplied by the cab of the first base element 210 and the equipment housing extension 210*a*, FIG. 10 illustrates a wind screen, or shelter, 390 to protect workers on the drilling apparatus in extreme climates. The screen 390 extends rearwardly from the second base element 218 to the first base element 210 to which the screen is joined by use of a flexible screen joint 390*a*. The screen joint 390*a* permits the screen 390 to remain intact on the second base element 218, as well as joining the first base element 210, when the orientation of the second base element is altered relative to that of the first base element by use of the flexible base joint at 216. Such a screen, or one of similar design, may be employed with the embodiment shown in FIGS. 1–9. In any case, the self-propelled drilling apparatus of the present invention may be equipped with the necessary sheltering devices to meet the needs of the ambient climate.

With the exceptions and differences noted hereinbefore, the operation of the embodiment illustrated in FIGS. 10–16 is essentially the same as that of the embodiment illustrated in FIGS. 1–9.

The foregoing disclosure and description of the invention is illustrative and explanatory thereof, and various changes in the size, shape and materials as well as in the details of the illustrated construction may be made within the scope of the appended claims without departing from the spirit of the invention.

I claim:

1. Mobile drilling apparatus comprising:

(a) traction means for propelling said apparatus;

(b) first base means supported by and attached to said traction means;

(c) first power means mounted on said first base means for operating said traction means to effect said propulsion of said apparatus;

(d) second base means;

(e) joint means, connecting said first base means and said second base means, selectively adjustable over a range of angles of orientation about two mutually orthogonal axes of rotation, to permit said first base means and said second base means to be simultaneously oriented at different angles with respect to the horizontal;

(f) drill bit means for drilling;

(g) drill bit support means joined to said second base means; and (h) second power means on said second base means for controlling the height of said drill bit means.

2. Mobile drilling apparatus as defined in claim 1 wherein said drill bit support means comprises derrick means.

3. Mobile drilling apparatus as defined in claim 2 wherein said derrick means comprises:

(a) first derrick element;

(b) second derrick element; and (c) first hinge means connecting said first derrick element and said second derrick element, and about which said second derrick element may be selectively rotated.

4. Mobile drilling apparatus as defined in claim 3 further comprising third power means for selectively rotating said second derrick element about said first hinge means.

5. Mobile drilling apparatus as defined in claim 4 further comprising derrick support means, mounted on said first base means, for giving support to said second derrick element when said second derrick element has been rotated about said first hinge means to a position over said first base means.

6. Mobile drilling apparatus as defined in claim 4 wherein said third power means comprises fluid pressure piston-and-cylinder means.

7. Mobile drilling apparatus as defined in claim 4 further comprising second hinge means through which said derrick means is joined to said second base means, and about which said derrick means may be selectively rotated with respect to said second base means.

8. Mobile drilling apparatus as defined in claim 7 wherein said third power means may be used to selectively rotate said derrick means about said second hinge means.

9. Mobile drilling apparatus as defined in claim 4 wherein said traction means comprises tread means.

10. Mobile drilling apparatus as defined in claim 4 further comprising fourth power means for rotating said drill bit means to effect said drilling.

11. Mobile drilling apparatus as defined in claim 10 wherein said fourth power means comprises power swivel means supported by said derrick means.

12. Mobile drilling apparatus as defined in claim 10 further comprising weight means for applying generally downward force to said drill bit means.

13. Mobile drilling apparatus as defined in claim 10 further comprising casing means, for lining holes drilled by said drill bit means, insertable in said holes from said mobile drilling apparatus.

14. Mobile drilling apparatus as defined in claim 10 further comprising suction means for withdrawing material disengaged by said drill bit means.

15. Mobile drilling apparatus as defined in claim 14 wherein said suction means further comprises:

(a) first fluid passage means;

(b) second fluid passage means communicating with said first fluid passage means;

(c) material intake means communicating with said second fluid passage means;

(d) suction fluid means for effecting said withdrawal of said material disengaged by said drill bit means by flowing substantially along said first fluid passage means and substantially along said second fluid passage means thereby effecting lift on said disengaged material entering said material intake means; and (e) fifth power means for circulating said suction fluid means substantially along said first fluid passage means and substantially along said second fluid passage means.

16. Mobile drilling apparatus as defined in claim 1 further comprising third power means for selectively orienting said second base means, with respect to said first base means, about said joint means.

17. Mobile drilling apparatus as defined in claim 16 further comprising fourth power means for rotating said drill bit means to effect said drilling.

18. Mobile drilling apparatus as defined in claim 17 wherein said fourth power means comprises power swivel means.

19. Mobile drilling apparatus as defined in claim 18 further comprising suction means for withdrawing material disengaged by said drill bit means.

20. Mobile drilling apparatus as defined in claim 19 wherein said suction means further comprises:

(a) first fluid passage means;

(b) second fluid passage means communicating with said first fluid passage means;

(c) material intake means communicating with said second fluid passage means;

(d) suction fluid means for effecting said withdrawal of said material disengaged by said drill bit means by flowing substantially along said first fluid passage means and substantially along said second fluid passage means thereby effecting lift on said disengaged material entering said material intake means; and (e) fifth power means for circulating said suction fluid means substantially along said first fluid passage means and substantially along said second fluid passage means.

21. Mobile drilling apparatus as defined in claim 18 further comprising weight means for applying generally downward force to said drill bit means.

22. Mobile drilling apparatus as defined in claim 18 further comprising casing means, for lining holes drilled by said drill bit means, insertable in said holes from said mobile drilling apparatus.

23. Mobile drilling apparatus as defined in claim 16 wherein said drill bit support means comprises derrick means.

24. Mobile drilling apparatus as defined in claim 16 wherein said traction means comprises tread means.

25. Mobile drilling apparatus as defined in claim 23 further comprising hinge means through which said derrick means is joined to said second base means, and about which said derrick means may be selectively rotated with respect to said second base means.

26. Self-propelled hole-drilling apparatus comprising:

(a) traction means for propelling said apparatus;

(b) a base assembly comprising:

(i) first base means supported by and attached to said traction means;

(ii) second base means, and (iii) joint means, connecting said first base means and said second base means, selectively adjustable over a range of angles of orientation with respect to the horizontal about two mutually orthogonal axes of rotation, to permit said first base means and said second base means to be simultaneously oriented about said axes at different angles with respect to the horizontal in all operative positions of said drilling apparatus;

(c) first power means for operating said traction means to propel said apparatus;

(d) derrick means mounted on said base assembly;

(e) one hinge means, through which said derrick means is joined to said base assembly, and providing a third axis of rotation about which said derrick means may be selectively rotated with respect to said base assembly;

(f) second power means for selectively orienting said second base means about said two axes of rotation;

(g) power swivel means supported by said derrick means;

(h) third power means for controlling the height of said power swivel means;

(i) drill bit means suspended essentially below said swivel means and selectively rotatable by said swivel means for drilling holes; and (j) drill guide means, cooperating with said derrick means, for selectively controlling the direction of drilling of said holes with respect to said second base means.

27. Self-propelled hole-drilling apparatus as defined in claim 26 further comprising weight means, suspended essentially below said power swivel means, for applying generally downward force on said drill bit means.

28. Self-propelled hole-drilling apparatus as defined in claim 27 further comprising casing means, insertable from said self-propelled hole-drilling apparatus, for lining said drilled holes.

29. Self-propelled hole-drilling apparatus as defined in claim 28 wherein said traction means comprises tread means.

30. Self-propelled hole-drilling apparatus as defined in claim 26 wherein said traction means comprises tread means.

31. Self-propelled hole-drilling apparatus as defined in claim 26 further comprising casing means, insertable from said self-propelled hole-drilling apparatus, for lining said drilled holes.

32. Self-propelled hole-drilling apparatus as defined in claim 26 further comprising suction means for withdrawing material disengaged by said drill bit means during said hole drilling.

33. Mobile drilling apparatus as defined in claim 1 wherein said joint means comprises a pair of joint elements and means connecting said joint elements for relative rotation about one of said axes, and means connecting one of said joint elements to one of said base means for rotation about the other of said axes.

34. Mobile drilling apparatus as defined in claim 33 wherein said joint elements comprise a pair of joint discs coaxial with said one axis, said joint further comprising rack and pinion means cooperative between said discs for effecting relative rotation of said discs about said one axis.

35. Self-propelled hole-drilling apparatus as defined in claim 26 wherein said joint means comprise a pair of joint elements and means connecting said joint elements for relative rotation about one of said axes, and means connecting one of said joint elements to one of said base means for rotation about the other of said axes.

36. Self-propelled hole-drilling apparatus as defined in claim 35 wherein said joint elements comprise a pair of joint discs coaxial with said one axis, said joint further comprising rack and pinion means cooperative between said discs for effecting relative rotation of said discs about said one axis.

37. Mobile drilling apparatus as defined in claim 26 wherein said derrick means includes:

(a) a first derrick element;

(b) a second derrick element; and (c) another hinge means connecting said first derrick element and said second derrick element, and about which said second derrick element may be selectively rotated.

38. Mobile drilling apparatus as defined in claim 26 wherein said one hinge means connects said derrick means to said joint means of said base assembly.

* * * * *